US006880307B2

(12) United States Patent
Schwitte et al.

(10) Patent No.: US 6,880,307 B2
(45) Date of Patent: Apr. 19, 2005

(54) PANEL ELEMENT

(75) Inventors: Richard Schwitte, Gescher (DE); Ansgar Mensing, Heek-Nienborg (DE)

(73) Assignee: Hulsta-Werke Huls GmbH & Co., KG, Stadtlohn (DE)

( * ) Notice: Subject to any disclaimer, the term of this patent is extended or adjusted under 35 U.S.C. 154(b) by 0 days.

(21) Appl. No.: 10/192,338

(22) Filed: Jul. 10, 2002

(65) Prior Publication Data

US 2003/0037504 A1 Feb. 27, 2003

Related U.S. Application Data

(63) Continuation of application No. PCT/EP01/00359, filed on Jan. 12, 2001.

(30) Foreign Application Priority Data

Jan. 13, 2000 (DE) ..... 100 01 076

(51) Int. Cl.[7] ..... E04B 2/08; E04B 2/18; E04B 2/32; E04B 2/46

(52) U.S. Cl. ..... 52/592.1; 52/592.2; 52/590.2; 52/591.3; 52/589.1; 52/578

(58) Field of Search ..... 52/592.2, 592.4, 52/590.3, 590.2, 591.3, 589.1, 177, 586.1, 592.1, 578, 592.3; 403/364, 375, 381

(56) References Cited

U.S. PATENT DOCUMENTS

| | | | | |
|---|---|---|---|---|
| 1,124,228 A | | 1/1915 | Houston | |
| 2,740,167 A | | 4/1956 | Rowley | |
| 4,426,820 A | | 1/1984 | Terbrack et al. | |
| 5,295,341 A | | 3/1994 | Kajiwara | |
| 5,348,778 A | | 9/1994 | Knipp et al. | |
| 5,540,025 A | | 7/1996 | Takehara et al. | |
| 5,630,304 A | | 5/1997 | Austin | |
| 5,797,237 A | * | 8/1998 | Finkell, Jr. | 52/589.1 |
| 6,094,882 A | | 8/2000 | Pervan | |
| 6,098,365 A | * | 8/2000 | Martin et al. | 52/592.1 |
| 6,101,778 A | | 8/2000 | Mårtensson | |
| 6,205,639 B1 | | 3/2001 | Pervan | |
| 6,209,278 B1 | | 4/2001 | Tychsen | |
| 6,216,409 B1 | | 4/2001 | Roy | |
| 6,247,285 B1 | | 6/2001 | Moebus | |
| 6,332,733 B1 | * | 12/2001 | Hamberger et al. | 403/329 |
| 6,345,481 B1 | | 2/2002 | Nelson | |

(Continued)

FOREIGN PATENT DOCUMENTS

| | | |
|---|---|---|
| CA | 991373 | 6/1976 |
| CH | 562377 | 11/1972 |
| DE | 2940945 A1 | 4/1981 |

(Continued)

*Primary Examiner*—Carl D. Friedman
*Assistant Examiner*—Chi Q. Nguyen
(74) *Attorney, Agent, or Firm*—Wolf, Greenfield & Sacks, P.C.

(57) ABSTRACT

The invention relates to a panel element for forming a floor covering, consisting of several identical interconnectable panel elements and having the following features: two first sides of each panel element, called the "longitudinal sides", these sides having a groove and a tongue; the tongue of a panel element which is positioned at an angle with an installation level of a first, identical panel element can be introduced into the groove of the first panel element; the tongue interacts with the groove of the adjacent, identical panel element in such a way that two interconnected panel elements are protected against separating forces which are exerted along both of the axes extending perpendicularly to the longitudinal side of the panel elements; two second sides of the panel element, called the end sides, are provided with fixing means and a groove and tongue, these forming an end-side connection between two adjacent panel elements; the end-side grooves and tongue can be interconnected by means of the panel element being lowered onto an identical panel element that has already been installed, essentially crosswise to the installation level, so that the panel element is protected from lifting forces, i.e. forces which are exerted considerably perpendicularly to the installation level.

34 Claims, 7 Drawing Sheets

U.S. PATENT DOCUMENTS

| | | | | |
|---|---|---|---|---|
| 6,385,936 | B1 * | 5/2002 | Schneider | 52/589.1 |
| 6,497,079 | B1 * | 12/2002 | Pietzer et al. | 52/592.4 |
| 6,505,452 | B1 | 1/2003 | Hannig et al. | |
| 6,510,665 | B1 | 1/2003 | Pervan | |
| 6,521,314 | B1 * | 2/2003 | Tychsen | 428/60 |
| 6,526,719 | B1 * | 3/2003 | Pletzer et al. | 52/592.2 |

FOREIGN PATENT DOCUMENTS

| | | | |
|---|---|---|---|
| DE | 3343601 | C2 | 2/1987 |
| DE | 4122099 | C1 | 10/1992 |
| DE | 19503948 | A1 | 8/1996 |
| DE | 42 42 530 | C2 | 12/1996 |
| DE | 29710175 | U1 | 8/1997 |
| DE | 29803708 | U1 | 5/1998 |
| DE | 19718319 | A1 | 11/1998 |
| DE | 19851200 | C1 | 11/1998 |
| DE | 20001788 | U | 2/2000 |
| DE | 29922649 | U1 | 4/2000 |
| DE | 20008708 | U | 5/2000 |
| EP | 0085196 | A1 | 10/1983 |
| EP | 0562402 | A1 | 3/1993 |
| EP | 0877130 | B | 4/1994 |
| EP | 0715037 | A1 | 6/1996 |
| EP | 0855482 | B | 12/1999 |
| EP | 1045083 | A1 | 10/2000 |
| FR | 2278876 | | 10/1973 |
| FR | 2785633 | A1 | 5/2000 |
| GB | 424057 | | 7/1934 |
| GB | 812671 | | 6/1956 |
| GB | 1161838 | | 8/1969 |
| GB | 1 430 423 | | 3/1976 |
| GB | 2256023 | A | 11/1992 |
| JP | 3-169967 | | 7/1991 |
| JP | 6-200611 | | 7/1994 |
| JP | 7-180333 | | 7/1995 |
| JP | 7-300979 | | 11/1995 |
| WO | WO 9627719 | A | 9/1996 |
| WO | WO 96/27721 | | 9/1996 |
| WO | WO 98/58142 | | 6/1997 |
| WO | WO 97/47834 | | 12/1997 |
| WO | WO 0047841 | A | 8/2000 |
| WO | WO 00/63510 | A1 | 10/2000 |
| WO | WO 01/02669 | A1 | 1/2001 |
| WO | WO 01/02670 | A1 | 1/2001 |
| WO | WO 01/48332 | A1 | 7/2001 |
| WO | WO 01/88306 | A1 | 11/2001 |

* cited by examiner

PANEL ELEMENT

This application is a continuation of prior application number PCT/EP01/00359, filed on Jan. 12, 2001, entitled PANEL ELEMENT, and now pending.

FIELD OF THE INVENTION

The invention relates to panel elements as set forth in the preamble of claim 1.

Panel elements for forming floor coverings are usually rectangular and elongated, although they may also feature other contours in being configured square, for example. Accordingly, in keeping with the usual rectangular configuration terms such as "side", "end" or the like are employed in the following without the invention being restricted to elongated panel elements. These terms serve in addition merely to distinguish first and second edges of the panel element each arranged parallel to the other in pairs and at an angle relative to the edges designated otherwise so that the geometry of the panel element provided for the "side" may also be provided at the other, for example, "end".

PRIOR ART

Known from GB 2,256,023 A is a generic panel element. It is provided for in the floor covering formed of several such panel elements that the individual panel elements feature a certain mobility relative to each other. This enables, especially when the panel elements are made of wood and the wood "works" due to exposure to the weather or due to the influence of moisture, any opening up of joints between adjoining panel elements to be avoided since the clearance possible between adjoining panel elements as provided is designed to accommodate such movements of the natural material wood.

In some applications and depending on the furnishing style it may however be desirable to restrict the mobility of adjoining floor panel elements in preventing dirt from gaining access to the gaps as may materialize between adjoining panel elements. This is why it is known to fabricate non-generic floor coverings such that the tongue and groove geometries provided therein do not already prevent parting of adjoining floor panel elements so that these elements can be first simply jointed, namely married and not fixedly connected until glued and safeguarded against the cited parting forces whilst, on the one hand, being regularly sealed by the aforementioned glueing procedure so that at the joints of two adjoining panel elements neither moisture nor dirt is able to gain access.

Known from EP 0 085 196 A1 is a non-generic mat for forming a floor covering in which the complete edge is provided with coupling elements each complementary to the other. The coupling elements are configured at two edges as a groove open upwards and at the two other edges as a key extending downwards in thus enabling a mat to be joined to further mats of the same kind by it being urged at two edges simultaneously with its key facing downwards into the upwards open groove of mats already laid.

It is known in the field of the generic panel elements from WO 96/27719 to configure a groove from two adjoining edges of an elongated panel element, i.e. a side and an end, and to provide the lower cheek of the groove as a protruding element including a channel for receiving a complementary interlocking element at the opposite side in each case. The complementary interlocking element is configured to a certain extent at the underside of a tongue for inserting into the groove. As cited in this document these interlocking contours are configured the same on all four edges, it further being stated that laying is done in rows. This means that the panel elements of one row to be laid juxtaposed first need to be married at their ends before then being connected married by their sides to the sides of the panels already laid. Such a procedure is, however, relatively laborious and a nuisance since several panel elements interlocked by their ends need to be handled.

By contrast it is known from DE 200 01 788 U1 to configure interlocking contours provided at a tongue and groove joint of the sides such that a second panel is swiveled in place with an already laid first panel before then being down-swivelled so that the tongue accesses the groove. By a subsequent shifting movement made parallel to the side edge a tongue provided at the end and including an interlocking element configured thereon is introduced into the groove of an already laid laterally adjoining panel. For this purpose at least the lower cheek of the groove provided at the end is configured flexible so that the tongue of the newly laid panel together with its interlocking element enters into the groove and can be interlocked by means of a retaining channel configured on one cheek of the groove. There is, however, likewise room for improving this procedure in simplifying laying.

Known from FR 2 278 876 A are panel-type elements provided at all four edges with interlocking means by means of which a panel to be newly laid can be interlocked with already laid adjoining panels by an urging movement made substantially perpendicular to the panel surface. A similar arrangement can be seen from EP 0 085 196 A1.

In conclusion, WO 00/47841 A1 describes floor panels provided at all four edges with projections or receiving grooves so that a panel can be urged in the vertical direction by the lateral interlocking means into the interlocking means of already laid panels, formed complementary thereto.

SUMMARY OF THE INVENTION

The invention is based on the objective of providing panel elements for forming a floor covering permitting simple glueless laying of the floor covering whilst achieving and reliably maintaining a snug clearance-free contact in joining adjoining panel elements.

The objective forming the basis of the invention is achieved by the panel elements having the features as set forth in claim 1.

In accordance therewith two first edges, termed sides, of the panel elements in accordance with the invention comprise, on the one hand a groove and on the other a tongue. In other words, the one side of a rectangular, more particularly elongated panel element is provided with a groove and the other opposite side a tongue. It is understood that the panel elements in accordance with the invention may be just as well configured square so that two first edges, which must not be necessarily longer than the two edges as detailed in the following, are provided with a tongue and groove. At these first edges grooves and tongues formed complementary thereto are configured such that a second panel is located for laying at an angle to a first panel already laid before being swiveled about the side downwards in a plane with the already laid panel element such that the tongue of the panel element to be laid is introduced into the groove of the already laid panel element.

In the final laid condition the tongue of the second panel element cooperates with the groove of the first panel element of the same type adjoining the second panel element in the final condition such that the two married panel elements are safeguarded against parting forces acting in the two axes oriented perpendicular to the side of the panel elements. In other words, the cooperation of the tongue and groove prevents any of the two panel elements from being lifted out of place relative to the other in a direction perpendicular to the laying plane, i.e. perpendicular to the face surface of the panel elements. For another thing, tongue and groove comprise interlocking contours as detailed in the following for preventing parting of the two panel elements from each other in a direction perpendicular to the sides and parallel to the face surface.

In accordance with the invention retaining means are also provided at two edges termed ends of the panel element which form an end joint of two adjoining panel elements. These retaining means, just like the retaining means at the sides in accordance with the invention prevent the married panel elements from being lifted relative to each other or parted from each other in a direction perpendicular to the ends and parallel to the laying plane. Any suitable means may be provided as such retaining means. More particularly, these must not be necessarily configured as an interlockable tongue and groove. Instead, in general a groove or a channel suitable undercut may be provided into which a protruding element, i.e. a tongue having protuberances corresponding to the undercut of the groove configured complementary thereto or a latching protuberance or hook, engages.

In a completely novel approach as compared to prior art the end retaining means can be married by means of a lowering movement made substantially transversely to the laying plane of a panel element to be laid in the direction of a similar panel element already laid. In other words, in a departure from known from prior art, end interlocking is now achieved in that a panel element to be laid is correctly arranged also as regards the end on laying and that a swivel movement in the laying plane not only causes the tongue at the side to engage the corresponding groove but also at the same time a lowering movement produced at the same time perpendicular to the laying plane likewise engages the retaining means, i.e. the tongue or the latching protuberance at the end. This interlocking feature is configured more particularly in accordance with the invention so that two panel elements to be married as described are now reliably safeguarded at the ends against parting forces acting perpendicular to the end and parallel to the laying plane as well as against lifting forces acting substantially perpendicular to the laying plane. The result is a particularly simple yet reliable laying of a floor covering comprising several panel elements in accordance with the invention. Now, namely a single swivel or turning movement suffices to interlock a panel element to be laid at both its side and its end. To this extent, the invention also relates to a laying method characterized by locating a panel element to be laid by its tongue at the side at an angle to an already laid panel element and joining it thereto at both the side as well as, without any further shift in the direction of the side, at the end by a swivel-down movement.

In configuring the interlocking contours at the side, more particularly of the retaining channel and rib, a prominent profiling may be provided to achieve high retaining forces of the married panel elements. In a departure from the laying method as is often employed, in which a panel element is shift-located horizontally to the already laid panel element, it is now provided for in accordance with the invention that the panel elements when laying the floor covering are no longer shifted into each other horizontally, but guided into each other by means of a swivel movement. This now permits selecting a prominent profiling of retaining channel and rib which would not permit two panel elements to be shifted into each other horizontally. However, by making use of a less prominent profiling and flexible configuration of the edge portion it is still possible to make use of the usual purely horizontally shifting method in laying.

It is to be noted that the invention is not restricted to the way of marrying and interlocking the sides as described above. Instead, it is just as conceivable and as is cited as a novelty at this point that an interlocking contour can now be provided at all edges of a substantially rectangular floor panel as may be provided as a laminate having a HDF or MDF centerply or as a finished parquet having both a HDF or MDF centerply as well as centerply of wood. On being inserted into the interlocking contours of adjoining floor panels already laid, this interlocking contour latches in place in a direction substantially perpendicular to the face surface of the panels. In other words, the interlocking contour provided in accordance with the invention at the ends, which on laying by being guided into the interlocking contour complementary thereto engages in a substantially horizontal direction, may also be provided at the sides. For example, an end and the adjoining side may be provided with one form of such a interlocking contour, and the two other edges may comprise the form complementary thereto. In the course of laying, such a panel element is positioned at both the side and the end to some extent to the interlocking contours of the already laid panel element before then being urged into the interlocking contours substantially perpendicular to the face surface to form a joint at these locations. It is to be noted in this context that all embodiments of the interlocking contours as described in the following relative to the ends are just as suitable and conceivable likewise for the sides. It is further again emphasized that the embodiment as described above can be used to advantage also without the swivable joint as otherwise described at the sides. In summary the "snap fastener" solution as described in accordance with the invention for the end may be provided at all edges of the panel.

The panel element in accordance with the invention develops its advantages particularly also in the preferred embodiment involving, as is to be preferred, not a laminate having a HDF or MDF centerply, but a finished parquet which may feature a centerply of HDF, MDF, plastics, some other wood-based material or also popular pinewood fingers. It is especially as regards the popular centerply of pine fingers comprising a comparatively irregular and rough face surface including faults, rosin galls and the like that the panel element in accordance with the invention offers the advantage that two panel elements adjoining each other by their sides now do not need to be shifted relative to each other. If this were the case, finished parquet on which the interlocking contours in accordance with the invention are provided at the sides could only be shifted with difficulty and with the aid of tools parallel to the sides to also interlock the ends. Now, in accordance with the invention no shifting in this direction is needed. Instead, the ends can now be engaged and latched during the same movement, namely the swivel-in movement ensuring interlocking at the sides, substantially without any horizontally shift.

Preferred further embodiments read from the sub-claims.

As regards the interlocking reliability, especially at the side, it is good practice to configure the tongue such that it comprises at its underside a rib running in the longitudinal direction of the tongue and that the groove corresponding features at its underside, i.e. at the lower cheek of the groove, a retaining channel for receiving the rib. Good results have been achieved therewith in rendering laying both simple and reliable.

It is preferably provided for that the groove opens upwards at its mouth in thus facilitating insertion of the tongue of a panel element located at an angle. This enables the rib provided on the underside of the tongue to protrude comparatively far downwards from the tongue in enabling high retaining forces to materialize after the floor covering has been laid. This reliably prevents parting of the two adjoining panel elements in the laying plane of the floor, in other words in preventing them from being pulled apart transversely to the longitudinal direction of the panel element. Furthermore, bevelling the upper cheek of the groove, instead of the underside of the tongue, offers the advantage that the tongue comes into contact with the groove at both the top and bottom in a portion located relatively deeply in the groove in thus assuring a particularly rugged joint since the dimension between the two points of contact and joint spaced the most away from each other in the joint is comparatively large.

It is preferably provided for that the geometry of the tongue and groove results in a total of four contact locations between the two panel elements so that in this way the result is relatively rugged in also counteracting any parting forces acting transversely to the laying plane of the floor and which could otherwise cause, for example, the adjoining panel element to lift or tilt. A swivel movement acting opposite to the swivel movement about the side as needed for interlocking at this location could prompt or facilitate an unwanted release. The four contact locations counteract such an unwanted swivel movement of two joined panel elements and can produce a regular latching connection requiring a latching force to be first overcome to release the two joined panel elements. More particularly, two first contact locations are provided at the upper side and underside of the tongue. The third and fourth contact location are advantageously separate from each other such that at the third contact location, preferably between retaining rib and retaining channel, a contact is formed in a direction parallel to the laying plane, i.e. usually horizontally, more particularly at the sidewall of the retaining channel. At the fourth contact location preferably located at leading end of the lower cheek of the groove and at a location alongside the rib, contact is made at an angle to the direction of the third contact location, preferably substantially vertically so that the location of two joined panel elements is precisely defined in the vertical direction, more particularly perpendicular to the laying plane.

It is further preferred that the plane of the groove or tongue is displaced downwards so that above the groove or tongue a material thickness is provided at least equal to or even thicker than that below the groove or tongue. This enables the human or furniture forces exerted in day-by-day use of the floor covering to be better accommodated in reducing the load on the tongue and groove joint so that two adjoining panel elements are subjected to diminished parting forces.

Preferably provided above the tongue is an upper contact surface area extending up to the upper side of the panel element and to advantage a glue receiving channel is provided should the panel elements need to be laid permanently married by being glued. This glue receiving channel may be provided in the form of a recess extending longitudinally to and above the tongue, below the upper edge of the panel element, since it is in the region of this upper edge that a contact surface area for contacting an adjoining panel element is provided.

It may further be of advantage to provide two contact surface areas between two adjoining panel elements which prevent any movement in both directions transversely to the longitudinal direction of the panel element, i.e. on the one hand the contact surface area between the two panel elements so that the two panel elements cannot be shifted closer to each other, on the other, a second contact surface area as the contact surface area between the retaining channel, on the one hand, and the rib, on the other, so that the adjoining panel elements are safeguarded against forces tending to pull them apart. In this way, it is now possible to install the panel elements not only with zero clearance but also free of any gap in thus achieving a hygienically satisfactory floor covering featuring a practically closed face surface.

Tongue and groove interlocking the sides is additionally facilitated when the underside of the tongue runs rising to the free end of the tongue in thus enabling a panel element to be laid to be located at an angle to an already laid panel element particularly simply by its tongue before then being swivelled into place.

During the swivel movement on laying a panel element a latching point need to be overcome, it being this latching point that, after laying, reliably maintains the location of the laid panel elements. To achieve a smooth latching characteristic in thus simplifying laying, it is good practice to configure this latching point between the rib, on the one hand, and the retaining channel, on the other. In this arrangement the retaining channel in the region of this latching point is rounded with as large a radius as possible so that no sudden, but a gradual increase in the latching pressure to be overcome materializes.

It is provided for to advantage that the side groove of the panel element permits adjoining at the right-hand end of the end groove. In this context the terms "right-hand" and "left-hand" have been selected in a view from above and outside, i.e. not from the centerpoint of the panel element in viewing a panel element oriented ready for laying with its decorative face facing upwards. This groove arrangement is unusual in the normal procedure for laying panel elements and surprising since it is usually so that the side groove of a panel element adjoins the left-hand end of the end groove.

The usual systematic approach in laying floor coverings as implemented by professionals and as known from the instructions for laying commercially available floor panel element systems prescribes starting from a specific corner of the room. To reliably achieve a good joint of two adjoining panel elements a specific pressure force usually needs to be exerted, this usually involving use of a block, located on the groove edge of the panel element to be newly laid, and intended to receive and distribute the hammer blow so that the panel element to be newly laid is urged by the its tongue into the groove of an already laid panel element.

It may happen, especially when the floor is laid by non-professionals, that the block fails to be applied square on the groove edge with the risk of the edge being subjected to excessive force when struck, resulting in the edge of the panel element being deformed and the face surface damaged. This may result in an unwanted gap at the deformed location or a trip joint. Apart from this, this may endanger the wet seal of the floor.

The geometry as proposed in the present contributes towards an unusual systematic approach in laying the floor in which whilst keeping to the direction of laying as usual the block is now not located on the edge of a groove but on the edge of the tongue of the panel element. The forces need to be applied by the hammer blow to marry the two panel elements are not sufficient to cause deformation of the tongue as could obstruct proper joint of the two panel elements. Now, in any case, by applying the block to the tongue the face surface of the panel element does not suffer in thus reliably assuring the desired face surface quality of the floor covering.

For interlocking the ends preference is given to an embodiment in which the end groove and the end tongue each feature a preferably slotted recess, the recesses being oriented in the final laying condition to receive an extraneous tongue by means of which two panel elements adjoining each other at the ends are safeguarded in this case from lifting out of place.

As an alternative, good results have been obtained with one embodiment in which the end tongue is provided with at least one hook-shaped protuberance configured preferably on one or both sidewalls of the tongue. The hooks may be configured as latching hooks, they being configured bevelled in the insertion direction and featuring a protuberance oriented substantially parallel to the laying plane to prevent lifting out of place. As an alternative such protuberances may of course also be configured at the side flanks of the end groove.

In conclusion good results have also been obtained with an embodiment in which the tongue is provided, preferably at its end, with at least one bulge or bead which can be received by suitable recessed portions at the edges at the bottom of the end groove. To create additionally flexibility for such an interlocking feature these recesses may be configured larger than the bulges of the tongue.

BRIEF DESCRIPTION OF THE DRAWINGS

Example embodiments of the invention will now be detailled with reference to the drawings in which.

DETAILED DESCRIPTION OF PREFERRED EMBODIMENTS OF THE INVENTION

Figure 1:
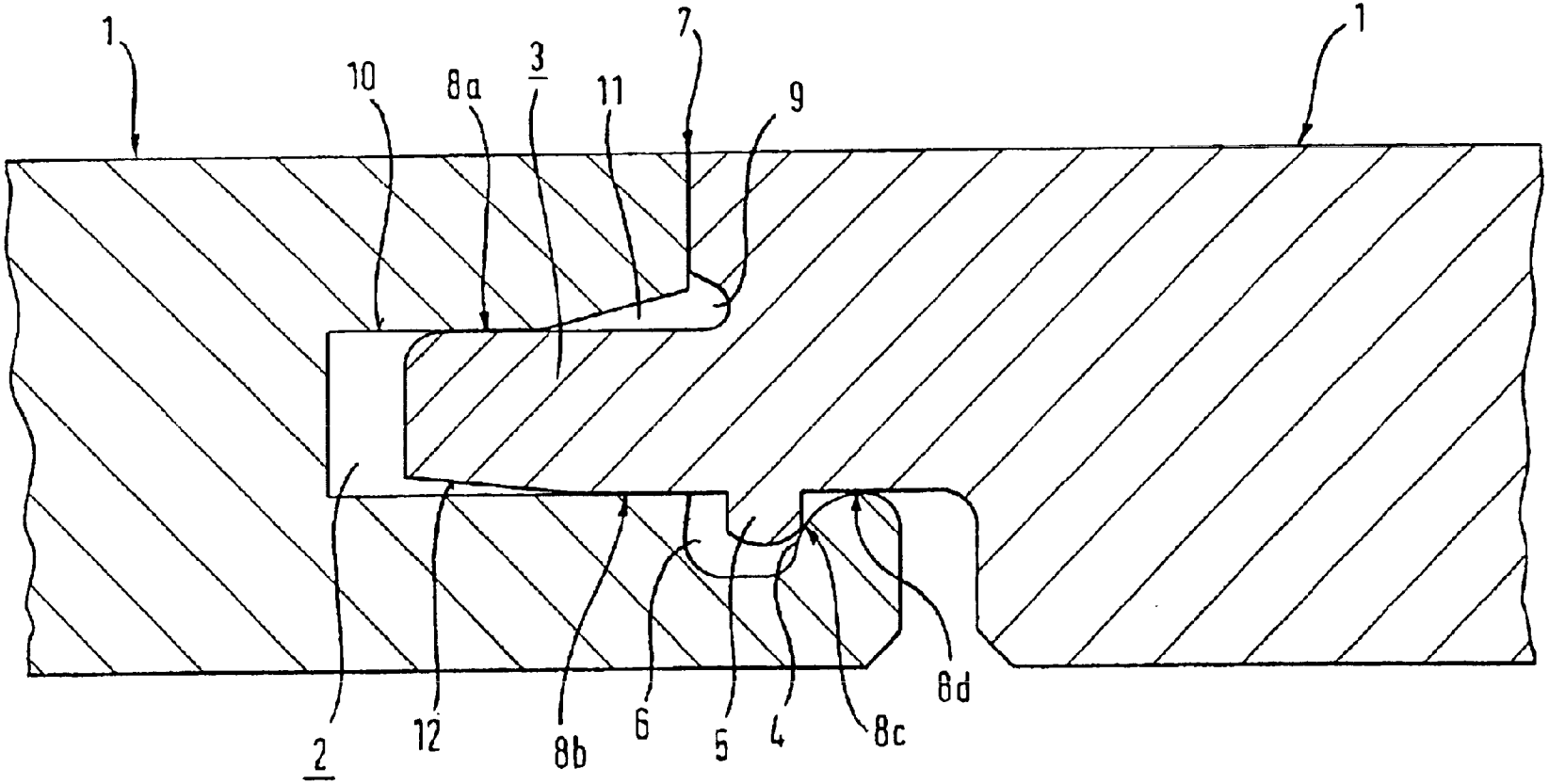
FIG. 1 is a cross-section through the portion of the tongue and groove configuration of the sides of two married panel elements.

Referring now to FIG. 1 there is illustrated two panel elements of the same type identified 1, the one panel element 1 comprising a groove 2 and the other panel element 1 a tongue 3 extending into the groove 2 of the adjoining panel element 1. The material thickness of the panel element 1 is slightly more below the groove 2 or above the tongue 3 than below the groove 2 or the tongue 3 respectively so that pressures exerted by human or furniture loads can be accommodated relatively well in loading the tongue and groove joint to a minimum.

The two panel elements 1 are safeguard against being lifted out of place by the meshing effect of the groove 2, on the one hand, and of the tongue 3 on the other, they likewise being safeguarded against compression forces acting downwards in addition to the support of the panel element 1 by the sub-floor on which the two panel elements 1 are laid.

The panel elements 1 are safeguarded against parting forces acting transversely to the longitudinal direction of the panel elements 1 by a contact surface area 4. Located along this contact surface area 4 a rib 5 configured at the underside of the tongue 3 contacts the sidewall of a retaining channel 6.

The forces acting contrary to these parting forces tending to urge the two panel elements 1 together are accommodated by a contact surface area 7 at which the two panel elements 1 are in contact with each other and which extends downwards from the upper edge of the two panel elements 1.

In the laid condition as evident from FIG. 1 four contact locations 8*a* to 8*d* materialize. In this arrangement, contact location 8*c* is identical to contact surface area 4. Due to these four contact locations 8*a* to 8*d* the two panel elements 1 are located as regards parting or angling forces so that the two panel elements 1 can only be shifted in parallel relative to each other in their longitudinal direction without any additional retaining force needing to be overcome.

In FIG. 1 a glueless joint of the two panel elements 1 is illustrated. A recess 9 above the tongue 3 and below the upper contact surface area 7 may serve, however, as a channel to receive excess glue should the two panel elements 1 need to be married permanently and gap-sealed with the aid of glue.

Figure 2:
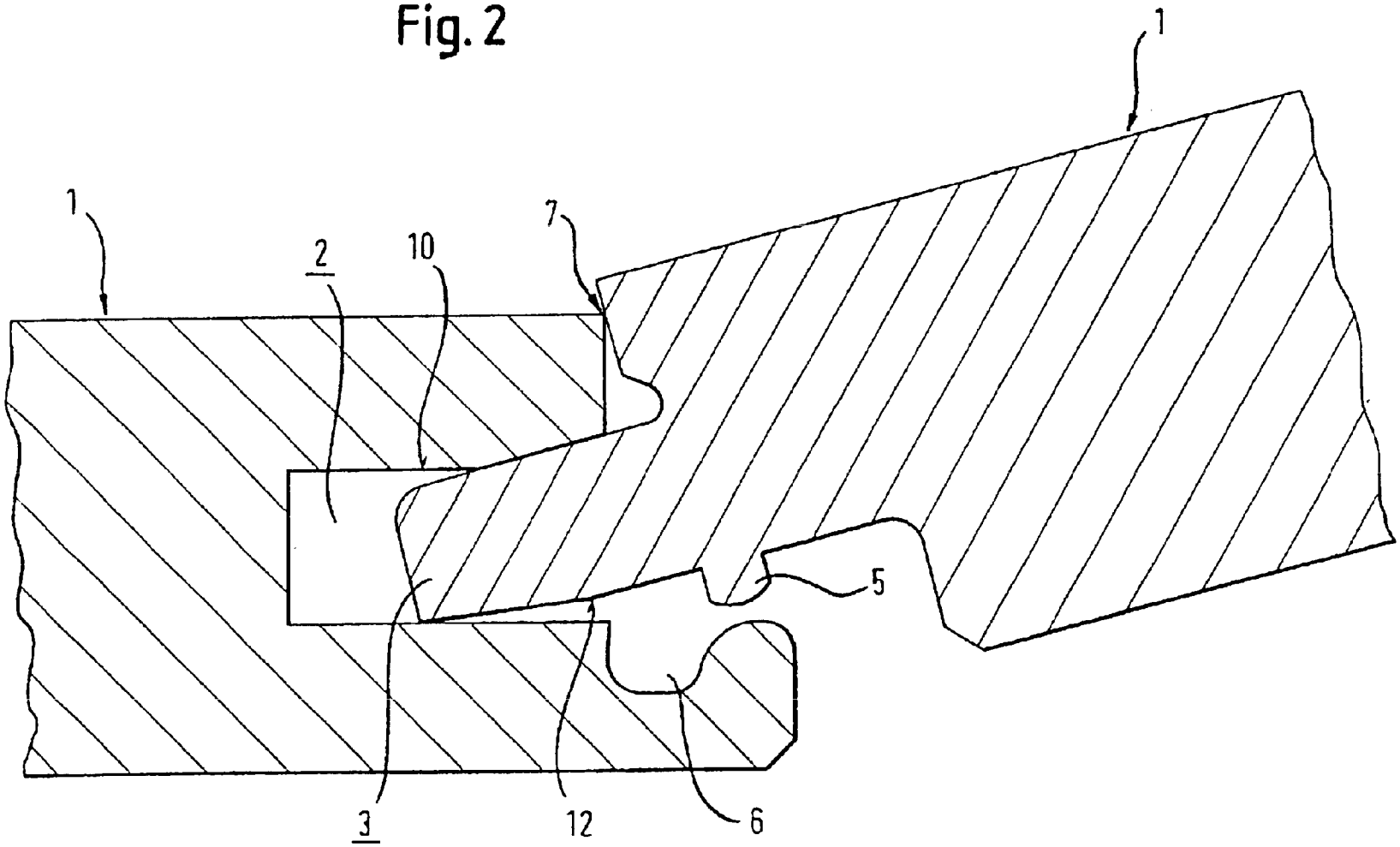
FIGS. 2 and 3 are cross-sections showing the joint of the sides of the two panel elements as shown in FIG. 1 in various stages in laying.

Referring now to FIG. 2 there is illustrated how the two panel elements 1 are laid, the left-hand panel element 1, of which the groove 2 is evident, being already laid. The second panel 1 is positioned by its tongue 3 at an angle to the side edge of the first panel 1 whereby the tongue 3 is inserted as far as possible into the groove 2. This is facilitated by the groove 2 comprising an upper edge 10 ramped in the direction of the mouth of the groove 2 in thus forming an insertion channel 11 as evident more particularly from FIG. 1.

Likewise the tongue 3 comprises an underside 12 ramped in the direction of the free end of the tongue 3 so that the right-hand panel element 1 can be inserted into the groove 2 as far as possible in its angled position as evident from FIG. 2. This insertion movement is defined, on the one hand, by the tongue 1 contacting the upper and lower defining edges of the groove 2 and, on the other, by the two panel elements 1 in contact with each other in the region of their upper contact surface area 7.

Figure 3:
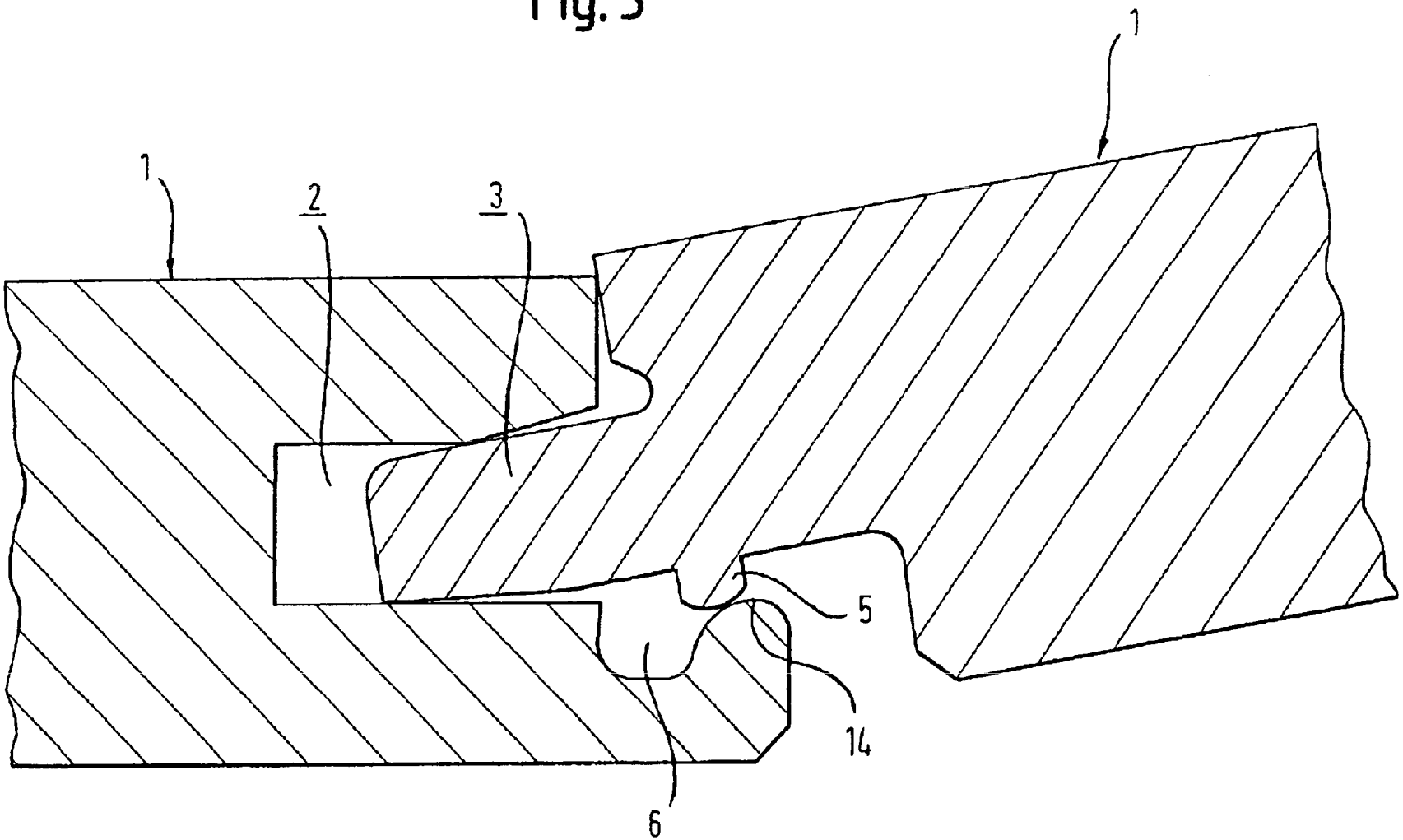

Referring now to FIG. 3 there is illustrated how the right-hand panel element 1 is angled less steeply than as shown in FIG. 2 so that it can be inserted further into the groove 3. In this arrangement the rib 5 comes up against a section 14 by its rounded lower edge, the section running between the retaining channel 6 and the side edge of the panel element 1. The transition from this section 14 to the retaining channel 6 features a relatively large radius: in the example aspect shown the radius of this rounding corresponds to roughly half the width of the retaining channel 6 or half the width of the material below the section 14.

It is due to this "smooth" rounding between the section 14 and the retaining channel 6 that a latching pressure is built up slowly on further insertion of the tongue 3 into the groove 2 which needs to be overcome when laying the right-hand panel element 1 until the two panel elements are then arranged married as shown in FIG. 1. In this laid condition the two panel elements 1 are mated snug, but also free of stress, the rib 5 being received by the retaining channel 6 free of stress. The latching pressure, which again needs to be overcome for the laid panel element 1 to be lifted out of place, locks the marriage of the two panel elements 1. It is to be noted in addition that the interlocking contours are configured such that at the receiving tongue 3 an oversize is formed. In other words, the dimension at the panel comprising the tongue 3 between the contact surface area 7 and the edge (on the right in FIG. 1) of the rib 5, i.e. the contact location 8*c*, is larger than the corresponding dimension at the panel comprising the groove, i.e. the dimension between the contact location 7 and that of the retaining channel 6 at which the third contact location 8*c* is configured. It is furthermore to be noted that the retaining channel is configured in all lightly rounded and that also the underside of the rib 5 is rounded. The third contact location 8*c* is, however, provided such that the tangent thereto is oriented at least substantially vertically so that, as a result of this, the panel elements are positioned in the horizontal direction relative to each other. The contact location 8*d* too, is configured in the vicinity of the retaining channel 6 at a rounded portion. The tangent thereto is, however, in the example aspect as preferred, oriented substantially horizontally, generally at an angle to the third contact location 8*c* so that the panel elements are positioned in the vertical direction relative to each other in thus preventing their release and any difference in level even when the sub-floor is uneven.

Figure 4:
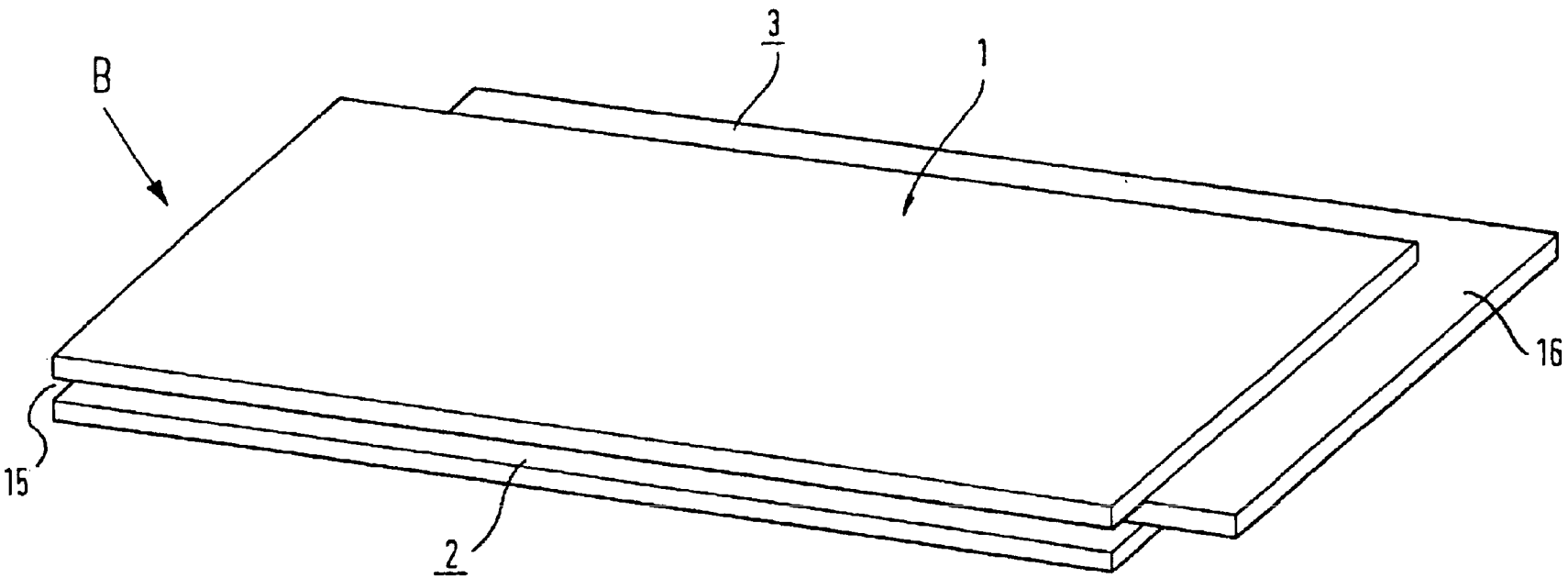
FIG. 4 is a diagrammatic view in perspective of simple detail illustrating the upper face of a panel element.

Referring now to FIG. 4 there is illustrated in a purely diagrammatic and perspective view a panel element 1 including a longitudinal groove 2 and tongue 3 each respectively. The panel element 1 is oriented ready for laying, i.e. with its fair or decorative face facing upwards. At its ends too, this panel element 1 is provided with an end groove 15 and an end tongue 16. In this arrangement, the longitudinal groove 2 adjoins the right-hand end of the end groove 15 as viewed in the direction "B" from above and outside of the panel element 1. In maintaining the usual laying direction of the floor covering this thus permits a systematic approach in laying in which, when the work is done with a hammer block, the block is not applied to the side edge of the panel element 1 at which the groove 2 is provided. Instead, the block can now be directly applied to the tongue 3 so that even when the block is not seated squarely any damage to the face surface of the panel element 1 is safely excluded.

The corresponding undercuts of the side groove 2 and tongue 3 respectively, i.e. particularly the configuration of the rib 5 and retaining channel 6 may in some circumstances be selected so pronounced that there could be a problem in horizontally mating in the laying plane. Now, however, such pronounced undercuts are not provided in the end tongue and groove geometry so that by shifting two adjoining panel elements 1 longitudinally relative to each other the end of the shifted panel element 1 can be joined to a further, third panel element 1.

Figure 5:
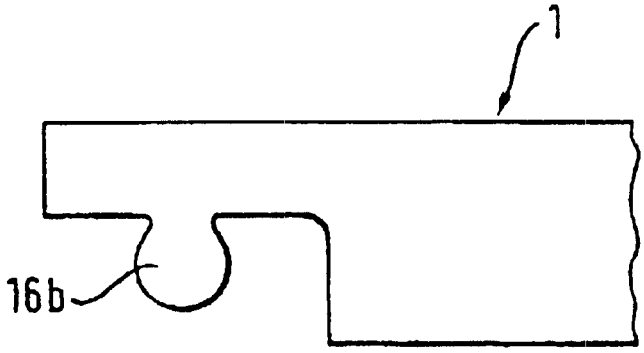
FIGS. 5 and 6 are cross-sections each showing an example aspect of an end tongue and groove configuration of a panel element.
Figure 6:
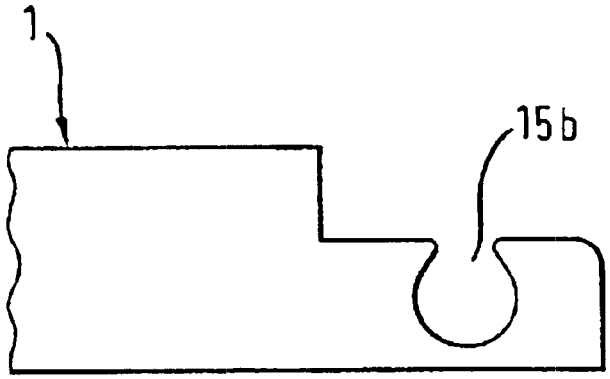

Referring now to FIGS. 5 and 6 there is illustrated an aspect in accordance with the invention pertaining to the end groove 15 and the end tongue 16 in which the tongue 16*b* does not extend in the horizontal plane of the panel element 1 but more or less perpendicular to this plane downwards. The corresponding groove 15*b* thus opens upwards to receive the tongue 16*b*.

For such a configuration of the end groove 15*b* and tongue 16*b* a method of laying is selected in which the panel element 1 to be laid is located at an angle to the already laid panel element and is then swivelled downwards in the way as already described. Then, however, this panel element is no longer shifted horizontally. Instead, the panel element is arranged right from the start to overlap by its end the end of an already laid panel element 1 so that swivelling down the panel element to be laid causes its end with the tongue 16*b* to engage the groove 15*b* of the end of the already laid panel element 1. Although this movement of the lowered panel element 1 is a swivelling movement in actual fact, the mating of groove 15*b* and tongue 16*b* can be substantially described as a lowering movement occurring transversely to the face surface area of the panel element 1.

In this arrangement, the groove 15*b* comprises an undercut and the tongue 16*b* is contoured with corresponding protuberances, i.e. in the example aspect as illustrated purely diagrammatic with a slightly bulging contour so that on overcoming a latching force with which the tongue 16*b* is urged into the groove 15*b* retaining forces can be built up which safeguard a laid panel element 1 from lifting out of place also at its edge portion in now making it possible to configure a smooth floor face surface free of trip edges even in the region of parting locations at the ends of two adjoining panel elements.

Contouring the tongue 16*b* and groove 15*b* as shown purely diagrammatically and bulging in FIGS. 5 and 6 now permits, in overcoming the corresponding latching forces, non-destructive disassembly of the panel elements 1 and release of their end marriage. It is particularly when the tongue 16*b* diverges at its underside relatively gradually and recombines further upwards more pronouncedly that this permits comparatively facilitated insertion of the tongue 16*b* into the groove 15*b* but results in considerably higher retaining forces which, however, make it more difficult to disassembly the two panel elements 1. In this case it may be provided for to part the ends from each other not by overcoming the latching forces but by a shifting movement in which groove 15*b* and tongue 16*b* are shifted mutually in their longitudinal direction.

The groove 15*b* comprises to advantage a larger free cross-section than the cross-section of the tongue 16*b* so that the tongue 16*b* can be retained "dead" or by a prestress acting downwards within the groove 15*b* in thus assuring even for certain dimension tolerances of the tongue 16*b* that no pressure locations materialize between the tongue 16*b* and groove 15*b* urging the tongue 16*b* upwards and which could produce a trip edge in the region of the parting location between the two ends of adjoining panel elements. Instead, it is now provided for to advantage that contact is made exclusively in each upper region between the groove 15*b* and tongue 16*b* so that the tongue 16*b* is reliably retained in the groove 15*b* due to the undercut therein.

Figure 7:
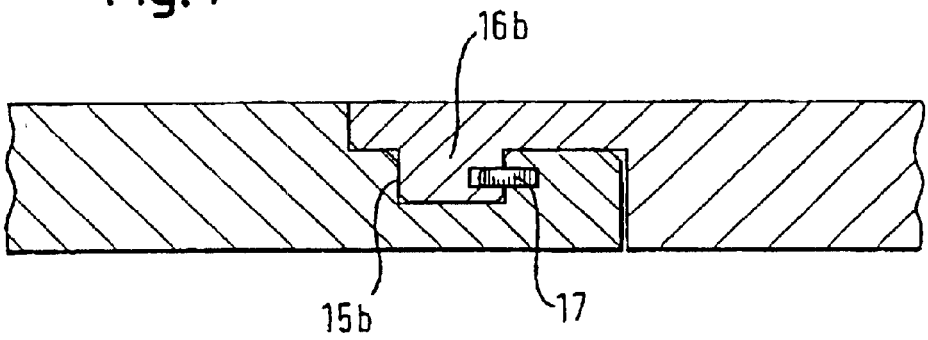
FIGS. 7 to 13 are cross-sections each showing a further example aspect of end jointed panel elements.

Referring now to FIGS. 7 to 13 there are illustrated further alternatives of the interlocking contours in accordance with the invention at the ends which may be termed in general as groove 15*b* and tongue 16*b*. In the embodiment as shown in FIG. 7 the tongue 16*b* is configured as a downswept protruding ledge on a lip configured at the upper edge of the panel element evident on the right. Swivelling the panel element evident on the right downwards causes the tongue 16*b* to enter the groove 15*b*. In the example aspect as shown final interlocking is achieved by an extraneous tongue 17 inserted parallel to the end which is partly received by one side of the tongue and partly in a flank of the groove. It is in this way that the panel evident on the right following the panel laid evident on the left can be interlocked by its end to the adjoining panel element. Safeguarding in a lateral direction (as shown in FIG. 7) is ensured by the tongue and groove joint whilst safeguarding the panels from being lifted out of place is assured by the extraneous tongue 17.

Figure 8:
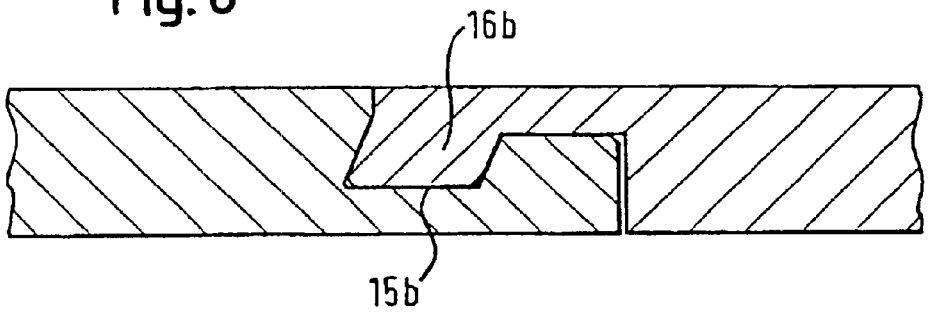

Referring now to FIG. 8 there is illustrated an embodiment in which safeguarding against side displacement forces is likewise achieved by the tongue and groove joint, except that in this case the tongue is configured at the leading edge of the lip. This further comprises two bevels which are received by the bevels of the groove 15*b* in thus preventing the right-hand panel from being lifted without it being slightly shifted to the right. This already prevents the panel from lifting out of place so that in this embodiment too, the two panels are non-releasably married in all directions.

Figure 9:
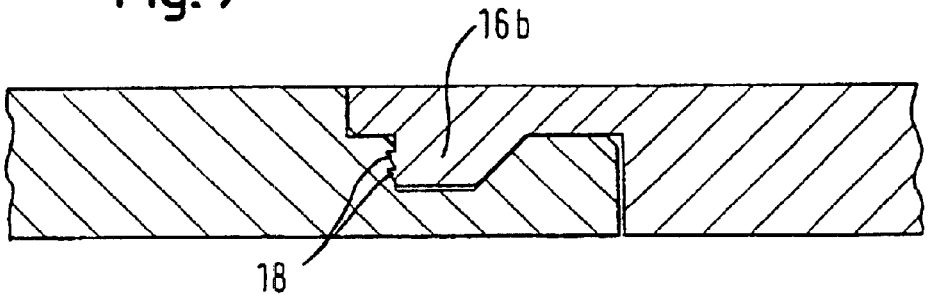

Referring now to FIG. 9 there is illustrated an embodiment in which safeguarding against lifting out of place is achieved by the tongue 16*b* comprising, on the one hand, a bevel whilst, on the other, the non-bevelled flank in the case as shown features several hook-type protuberances 18 preventing the panel on the right from lifting out of place. In other words, the protuberances 18 functioning like a barb or latching hook prevent the non-bevelled flank from passing by the latter to lift the right-hand panel out of place.

Figure 10:
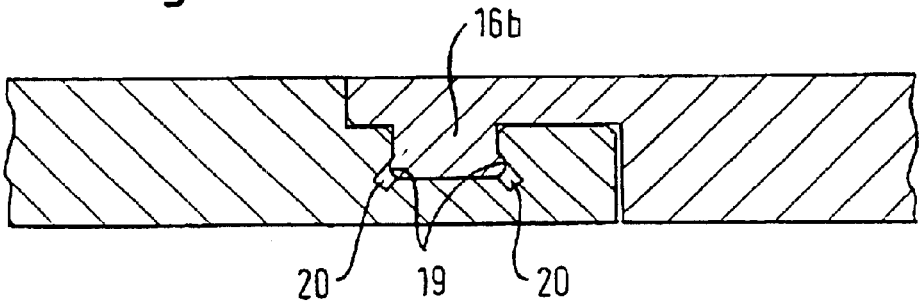

Referring now to FIG. 10 there is illustrated how this is achieved by the tongue 16*b* although featuring two substantially straight flanks, their leading ends being configured somewhat bulged or comprising beads. The groove 15*b* is correspondingly recessed at least slightly in the corner portions to result in an undercut 20 for latchingly engaging the widenings of the tongue.

Figure 11:
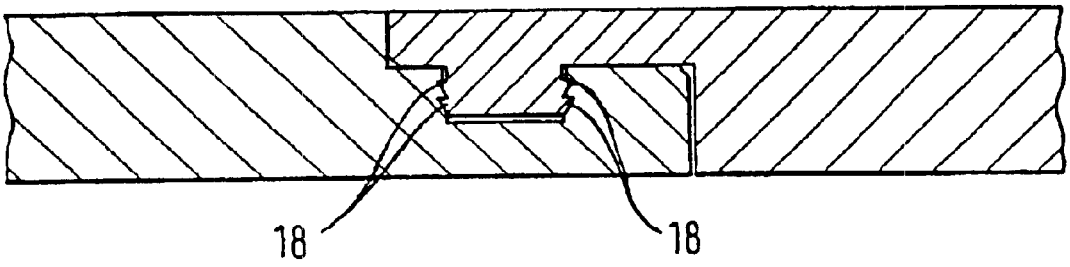

Referring now to FIG. 11 there is illustrated an embodiment similar to that as shown in FIG. 9 except that the tongue and the groove now comprise two straight flanks with protuberances 18 configured on the two flanks of the tongue which maintain the panel evident on the right in the laid position whilst safeguarding it against being lifted out of place.

Figure 12:
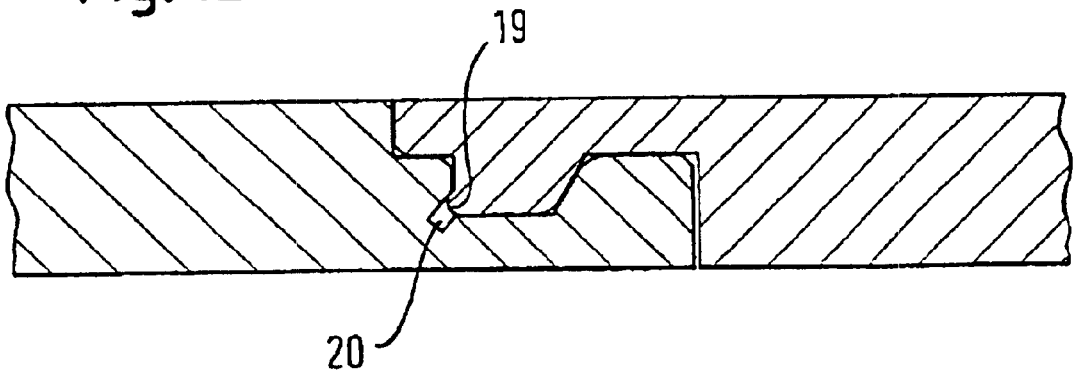

Referring now to FIG. 12 there is illustrated an embodiment similar to that as shown in FIG. 10, except that the bulge 19 or rounding at the leading end of the tongue element is provided only for one flank, and correspondingly the groove comprising a recess 20 only in a corner portion in which this bulge can be received. In addition, the recess 20, the same as in the embodiment as shown in FIG. 10, is configured somewhat deeper than is necessary for the bulge of the tongue. The reason for this is to endow the surrounding portion with a certain pliancy in permitting a flexible latching action.

Figure 13:
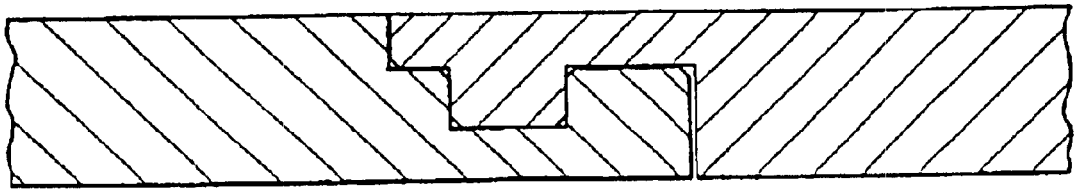

Referring now to FIG. 13 there is illustrated in conclusion an embodiment in which safeguarding against it being lifted out of place is assured by the tongue and the groove being dimensioned relative to each other such that the tongue is somewhat wider than the groove to be received so that in the laid condition a press fit materializes which safely maintains the two panels in contact. In this case too, the panel evident on the right is safeguarded against being lifted out of place at its end.

What is claimed is:

1. A panel element that is interlockable with other same type panel elements on a laying plane to form a floor, the panel element comprising:

a first long side having a long side groove and a second long side having a long side tongue, said long side tongue including a rib, and said long side groove including a retaining channel for receiving a rib of an adjoining same type panel element, said long side tongue of said panel element adapted to be located at an angle to the laying plane and to be inserted into a long side groove of an already laid same type panel element, said long side tongue further adapted to then be swiveled downwardly in a direction of the laying plane so that said long side tongue is positioned in the long side groove of the already laid same type panel element, and said rib is received in a retaining channel of the long side groove of the already laid same type panel element, said long side tongue of said panel element adapted to cooperate with the long side groove of the already laid same type panel element, when engaged, to prevent separation of said second long side of said panel element and a first long side of the already laid same type panel element in an upwards direction, and said rib adapted to cooperate with the retaining channel of the long side groove of the already laid same type panel element, when engaged, to prevent separation of said panel element and the already laid same type panel element in a sideways direction perpendicular to said second long side, a first short side of said panel element having an upwardly facing end groove and a second short side of said panel element having a downwardly facing end tongue adapted to mate with an upwardly facing end groove at a first short side of a previously laid panel element to prevent separation therebetween in a sideways direction perpendicular to said second short side of said panel element and to prevent separation in the upwards direction, said downwardly facing end tongue at said second short side of said panel element adapted to be mated to the upwardly facing end groove at the first short side of the previously laid same type panel element by the same swiveling movement that joins said long side tongue of said panel element to the long side groove of the already laid same type panel element.

2. The panel element as set forth in claim 1, wherein an upper edge of said long side groove is ramped upwards toward a mouth of said long side groove so as to create an insertion channel for a long side tongue of a same type panel element.

3. The panel element as set forth in claim 1, wherein the long side groove of a same type panel element and said long side tongue of said panel element define four contact points therebetween, when engaged.

4. The panel element as set forth in claim 1, wherein said panel element has a material thickness above said long side tongue or groove that is at least as thick as another material thickness of said panel element below said long side tongue or groove, respectively.

5. The panel element as set forth in claim 1, further comprising:

an upper contact surface area extending above said long side tongue up to an upper side of said panel element; and a recess located above said long side tongue and below said upper contact surface area for receiving glue.

6. The panel element as set forth in claim 5, wherein said panel element and the already laid same type panel element are engaged and-have contact at both said upper contact surface area, and between the retaining channel and said rib defining a lower contact surface area, said upper and lower contact surface areas producing snug, clearance-free contact of said panel elements and the already laid same type panel element at their long sides.

7. The panel element as set forth in claim 1, wherein an underside of said long side tongue ramps upwards to a free end of said long side tongue.

8. The panel element as set forth in claim 1, wherein a transition between said retaining channel and an outer portion of said long side groove includes a relatively large radius.

9. The panel element as set forth in claim 1, wherein said long side groove continues into said upwardly facing end groove.

10. The panel element as set forth in claim 1, wherein said upwardly facing end groove includes a slotted recess, which faces into another slotted recess of a same type panel element, when engaged, and into which an extraneous tongue is insertable.

11. The panel element as set forth in claim 1, wherein said downwardly facing end tongue includes at least one hook-shaped protuberance on at least one of its side surface areas.

12. The panel element as set forth in claim 1, wherein said upwardly facing end groove includes a recess at a corner portion of a bottom of said upwardly facing end groove.

13. The panel element as set forth in claim 12, wherein said downwardly facing end tongue includes a protrusion adapted for mutual engagement with a recess in the upwardly facing end groove of the previously laid same type panel element to prevent separation in the upwards direction.

14. The panel element as set forth in claim 1, wherein said rib is located at an underside of said long side tongue of said panel element and the retaining channel of the adjoining same type panel element is located at an upwardly facing surface of the long side groove of the adjoining same type panel element.

15. The panel element as set forth in claim 1, wherein said panel element includes multiple materials, said upwardly facing end groove and said downwardly facing end tongue being made of a first material and a top surface of said panel element being made of a second material different from said first material.

16. The panel element as set forth in claim 15, wherein said first material comprises fiberboard.

17. A panel element that is interlockable with other same type panel elements, said panel element comprising:

a body portion having a first pair of sides and a second pair of sides;

said first pair of sides including a first interlocking contour along a first edge portion and a second interlocking contour along a second edge portion, said first interlocking contour of said panel element being interlockable with a second interlocking contour of a same type panel element, and said second interlocking contour of said panel element being interlockable with a first interlocking contour on a same type panel element, to prevent separation of said first pair of sides of said panel element in an upwards direction and in a sideways direction perpendicular to said first pair of sides;

said second pair of sides including a first interlocking contour along a first edge portion, and a second interlocking contour along a second edge portion, said first interlocking contour of said second pair of sides including an upwardly facing groove having a lower end and a recess that extends beneath said lower end, and said second interlocking contour of said second pair of sides including a downwardly facing tongue having a protrusion, said protrusion adapted for receipt in a recess of an upwardly facing groove in a first interlocking contour of a second pair of sides of a same type panel element to prevent separation of said second interlocking contour of said second pair of sides of said panel element from the first interlocking contour of a same type panel element, in an upwards direction, when said second interlocking contour of said second pair of sides of said panel element and the first interlocking contour of the second pair of sides of the same type panel are interlocked.

18. The panel element as set forth in claim 17, wherein said tongue of said first pair of sides, when interlocked with an already laid panel element, prevents separation of said panel element and the interlocked already laid same type panel element in an upwards direction and also prevents separation of said panel element and the interlocked already laid same type panel element in sideways direction perpendicular to said first pair of sides.

19. The panel element as set forth in claim 18, wherein said downwardly facing tongue of said second pair of sides, when interlocked with a same type panel element, prevents separation of said panel element and the interlocked same type panel element in an upwards direction and also prevents separation of said panel element and the interlocked same type panel element in a sideways direction perpendicular to said second pair of sides.

20. The panel as set forth in claim 19, wherein said first pair of sides and said second pair of sides are engaged by rotating said panel element about an axis parallel to at least one of the first pair of sides.

21. The panel element as set forth in claim 20, wherein said first interlocking contour of said first pair of interlocking contours includes a long side groove, and said second interlocking contour of said first pair of interlocking contours includes a long side tongue, said long side tongue including a rib, and said long side groove including a retaining channel for receiving a rib of an already laid same type panel element.

22. The panel element as set forth in claim 21, wherein said first interlocking contour of said second pair of sides includes an upwardly facing end groove and said second interlocking contour of said second pair of sides includes a downwardly facing end tongue adapted to mate with an upwardly facing end groove of a second pair of interlocking contours of a previously laid panel element.

23. The panel element as set forth in claim 21, wherein an upper edge of said long side groove is ramped upwards toward a mouth of said long side groove so as to create an insertion channel for a long side tongue of a same type panel element.

24. The panel element as set forth in claim 21, wherein the long side groove of an already laid same type panel element and said long side tongue of said panel element define four contact points therebetween, when engaged.

25. The panel element as set forth in claim 21, wherein said panel element has a material thickness above said long side tongue or groove that is at least as thick as another material thickness of said panel element below said long side tongue or groove, respectively.

26. The panel element as set forth in claim 21, further comprising:

an upper contact surface area extending above said long side tongue up to an upper side of said panel element; and a recess located above said long side tongue and below said upper contact surface area for receiving glue.

27. The panel element as set forth in claim 21, wherein said panel element and the already laid same type panel element are engaged and have contact at both said upper contact surface area, and between the retaining channel and said rib defining a lower contact surface area, said upper and lower contact surface areas producing snug, clearance-free contact of said panel element and the already laid same type panel element at their long sides.

28. The panel element as set forth in claim 21, wherein an underside of said long side tongue ramps upwards to a free end of said long side tongue.

29. The panel element as set forth in claim 21, wherein a transition between said retaining channel and an outer portion of said long side groove includes a relatively large radius.

30. The panel element as set forth in claim 21, wherein said long side groove continues into said upwardly facing end groove.

31. The panel element as set forth in claim 21, wherein said upwardly facing end groove includes a slotted recess, which faces into another slotted recess of a same type panel element, when engaged, and into which an extraneous tongue is insertable.

32. The panel element as set forth in claim 21, wherein said downwardly facing end tongue includes at least one hook-shaped protuberance on at least one of its side surface areas.

33. The panel element as set forth in claim 21, wherein the recess extends at an angle toward a main body portion of said panel element.

34. A panel element that is interlockable with other same type panel elements on a laying plane to form a floor, said panel element comprising:

a first long side that is interlockable with a second long side of a same type panel element, and a second long side that is interlockable with a first long side of a same type panel element, said first and second long sides of said panel element including means for interlocking with the respective second and first long sides of same type panel elements to prevent separation of said first long side of said panel element and the second long side of a same type panel element and said second long side of said panel element and a first long side of a same type panel element, in an upwards direction and in a sideways direction perpendicular to said first and second long sides, by a swiveling movement of said panel element along said first long side relative to a second long side of a same type panel element and a swiveling movement of a first long side of a same type panel element relative to said second long side of said panel element;

wherein said means for interlocking comprises a long side groove on said first long side and a long side tongue on said second long side of said panel element, said long side tongue including a rib, and said long side groove including a retaining channel for receiving a rib of a long side tongue of an adjoining already laid same type panel element, said long side tongue of said panel element adapted to cooperate with a long side groove of the already laid same type panel element to prevent separation of said second long side of said panel element and a first long side of the already laid same type panel element in an upwards direction, and said rib adapted to cooperate with a retaining channel of the long side groove of the already laid same type panel element to prevent separation of said panel element and the already laid same type panel element in a sideways direction perpendicular said second long side;

a first short side of said panel element that is interlockable with a second short side of a same type panel element, and a second short side of said panel element that is interlockable with a first short side of a same type panel element, said first and second short sides of said panel element having means for mating with respective second and first short sides of same type panel elements to prevent separation of said first short side of said panel element and a second short side of a same type panel element and of said second short side of said panel element and a first short side of a same type panel element, in an upwards direction and in a sideways direction perpendicular to said first and second short sides of said panel element, by the swiveling movement of said panel element along said first long side relative to a second long side of a same type panel element, and by the swiveling movement of a first long side of a same type panel element that is adjacent to said second short side;

wherein said means for mating comprises an upwardly facing end groove on said first short side of said panel element and a downwardly facing end tongue on said second short side of said panel element adapted to mate with an upwardly facing end groove of a previously laid panel element to prevent separation therebetween in a sideways direction perpendicular to said second short side of said panel element, said downwardly facing end tongue adapted to be mated to the upwardly facing end groove at the previously laid same type panel element at the first short side of the previously laid same type panel element by the same swiveling movement that joins said long side tongue of said panel element to the long side groove of the already laid same type panel element.

* * * * *